United States Patent [19]

Nelson

[11] 4,096,602

[45] Jun. 27, 1978

[54] DRYER DOOR STOP ASSEMBLY

[75] Inventor: James K. Nelson, Marion, Ill.

[73] Assignee: Fedders Corporation, Edison, N.J.

[21] Appl. No.: 830,455

[22] Filed: Sep. 6, 1977

[51] Int. Cl.[2] ..... E05F 5/06

[52] U.S. Cl. ..... 16/85; 312/327; 126/194; 126/191

[58] Field of Search ..... 16/82, 85, 49, 191, 16/128 R, 128.1, 146, 139; 126/191, 194, 193; 312/327

[56] References Cited

U.S. PATENT DOCUMENTS

| | | | |
|---|---|---|---|
| 2,683,446 | 7/1954 | Groff | 16/85 |
| 2,683,447 | 7/1954 | Pollock et al. | 16/85 |
| 3,046,974 | 7/1962 | Kimberley | 126/191 |
| 3,155,088 | 11/1964 | Barber | 126/191 |
| 3,398,735 | 8/1968 | Barber | 126/194 X |
| 3,450,125 | 6/1969 | Hopkins | 16/191 |
| 3,521,319 | 7/1970 | Fisher | 126/194 |
| 3,698,781 | 10/1972 | Dunn | 126/194 |
| 3,842,542 | 10/1974 | White et al. | 126/194 |
| 4,001,973 | 1/1977 | Rice et al. | 126/194 |

FOREIGN PATENT DOCUMENTS

| | | | |
|---|---|---|---|
| 273,088 | 3/1962 | Australia | 16/171 X |

*Primary Examiner*—Ronald Feldbaum
*Attorney, Agent, or Firm*—McAulay, Fields, Fisher & Goldstein

[57] ABSTRACT

An arcuate door stop for use in limiting the opening of the door on a clothes dryer or other appliance having a similar type of downwardly pivoting access door, has an arcuate link pivotally secured, near one end, to the door and a plurality of detents spaced from the end secured to the door, which cooperate with a transverse roller mounted on the appliance to support the door in a like plurality of different open positions including a position in which the door is displaced substantially 180° from its closed position and in spaced relationship to the face of the cabinet appliance to permit unobstructed access to the interior of the appliance. A spring serves to both bias the link into engagement with the roller and to counterbalance the door.

5 Claims, 5 Drawing Figures

DRYER DOOR STOP ASSEMBLY

BACKGROUND OF THE INVENTION

This invention relates to a door stop assembly for use on a clothes dryer or other similar appliance. More particularly, the invention relates to an arcuate door stop assembly having a minimum of operable elements which permits the door of the appliance to be swung open and downward, out of the way, to give unobstructed access to the interior of the appliance through its loading portal. The invention further relates to an arcuate door stop assembly which limits and maintains the downwardly disposed fully opened door in spaced apart relationship to the appliance body thereby to prevent the scratching or otherwise marring of the face of the door with the body of the appliance by the dryer door. Moreover, the present assembly is operable to maintain the door in any one of a plurality of angular positions depending on the desires of the operator.

In loading clothes dryers, it is advantageous and desirable to be able to gain unobstructed access to the loading portal. It has been the practice to hinge the door closure for the loading portal to swing to one side to a fully opened position adjacent to, and often in contact with the side of the appliance body. Additionally, it is also often the case that the clothes dryer is located in a restricted area or "laundry room," when used in a consumer's home and, as a consequence, the door may open against other appliances or objects in the laundry room area. As is well known, and even when the newer epoxy finishes are employed, constant tapping or colliding of the finish with another hard surface will result in chipping and marring of the finish. In other cases, the space constraints prevent the door from being fully opened, thereby hampering loading and unloading of the appliance.

Some manufacturers have attempted to eliminate this problem by providing appliances with doors that open outwardly. However, this arrangement has been less than satisfactory since the doors, at best, open to a 90° position thereby causing the operator to reach in an uncomfortable manner when loading or unloading the appliance.

It is therefore an object of the present invention to provide a device which allows the door of a clothes dryer or similar appliance to be swung completely open and out of the way, but limits the maximum opening position to a position away from contact with the body of the appliance.

It is a further object of the invention to provide a device which will allow the door to be swung open while avoiding contact with other appliances or objects even in a restricted area.

Another object of the invention is to provide a device which will permit the door of an appliance to be opened to and maintained in any one of a plurality of different angular positions, including a position in which the door is opened to substantially a 180° position.

While there are door controls of the type under consideration that maintain a door in different angular positions, these controls or devices are usually complex and require a number of operable parts, all of which increase the maintainence and cost of the device. For example, U.S. Pat. No. 3,689,781 shows such a device which utilizes numerous elements for maintaining the door in a desired position, for counterbalancing the door, and for maintaining the control links in contact with the supports.

Accordingly, a further object of the invention is the provision of a simple assembly of the type described that is operable to both counterbalance and maintain the door of an appliance in a desired position and comprise a minimum of operating elements.

BRIEF DESCRIPTION OF THE INVENTION

The present invention is an arcuate door stop assembly for use in limiting the opening action of a clothes dryer door or similar appliance door. The assembly allows the door to be counterbalanced and also to be swung open and held in a plurality of different positions including a position substantially 180° in a downward direction from the normally closed position, but spaced apart from the body of the appliance. This provides for unobstructed access to the interior of the appliance while avoiding chipping of the surface finish of the door due to contact with the body of the appliance or with objects alongside the appliance.

The door of a clothes dryer, or other similar appliance for which the present invention is particularly useful, normally pivots about a hinge provided near its lower edge. This allows the door to be swung forward and downwardly from a closed position to a fully open position. A door stop assembly, according to the present invention, is pivotably secured near one side of the door, and has a first detent therein. The detent engages a transverse roller mounted on the appliance body, to hold the door substantially 180° displaced from its closed position. This not only allows the door to hang out of the way in a downward position but also allows the assembly to keep the door spaced apart from the appliance thereby to prevent impact damage or chipping to the face of the door and to the adjacent portion of the body of the appliance.

There is also provision, in the form of other detents, on the inner arcuate surface of the stop assembly which interengage with the transverse rollers to support the door in positions other than its fully opened positioned.

BRIEF DESCRIPTION OF THE DRAWINGS

Reference is made to the drawings wherein.

DESCRIPTION OF THE PREFERRED EMBODIMENT

Figure 1:
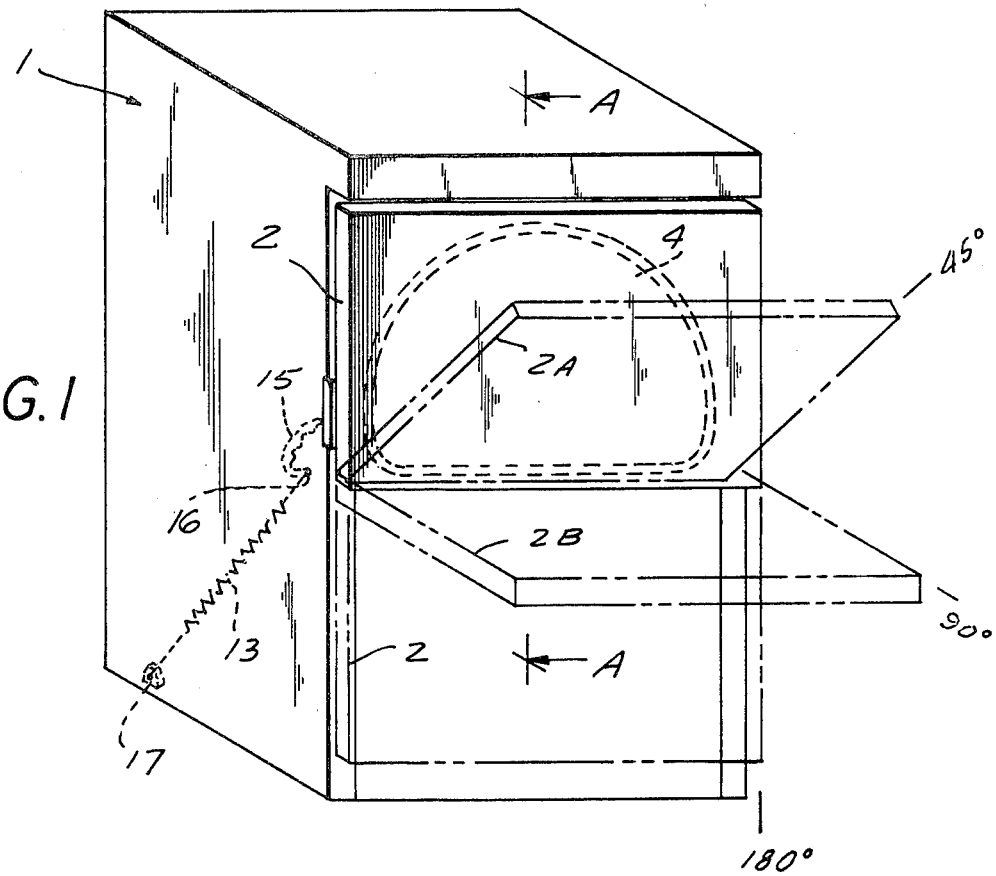
FIG. 1 is a perspective view of a clothes dryer or other appliance having a door pivotably secured to the appliance, normally along its lower edge, and showing the door in a fully closed, fully opened, and several intermediate positions.
Figure 2:
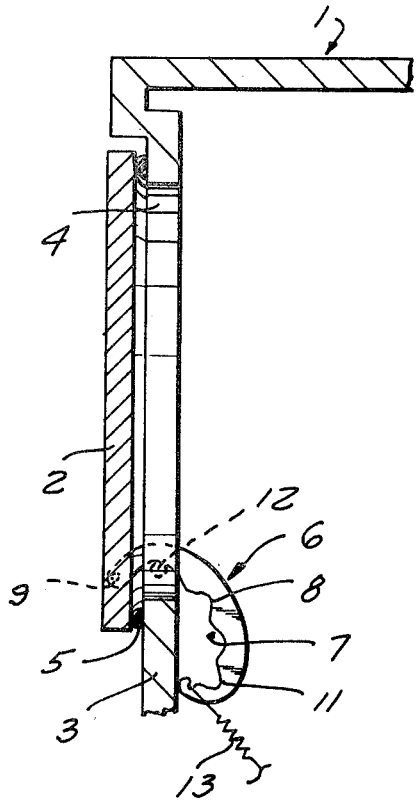
FIGS. 2–5 are sectional views of the device of FIG. 1 taken along the line A—A and showing details of the door stop assembly, according to the present invention, in interengagement as required by the various positions of the door illustrated in FIG. 1.
Figure 3:
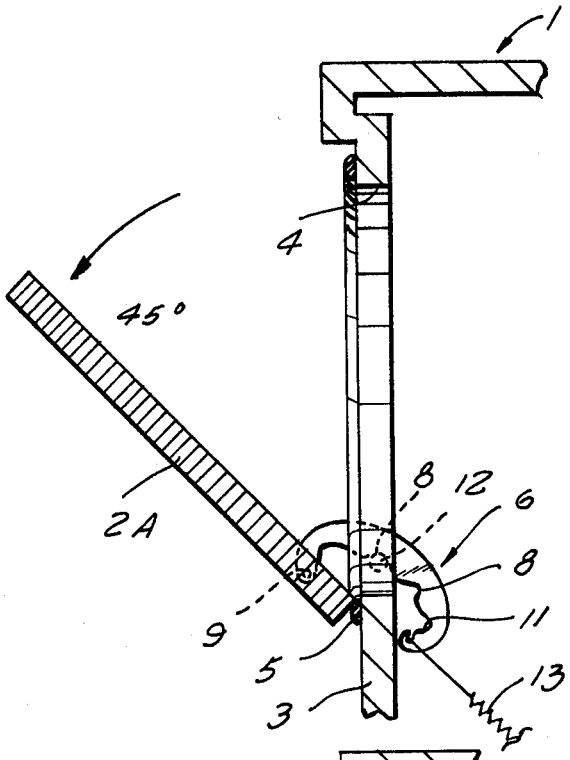
Figure 4:
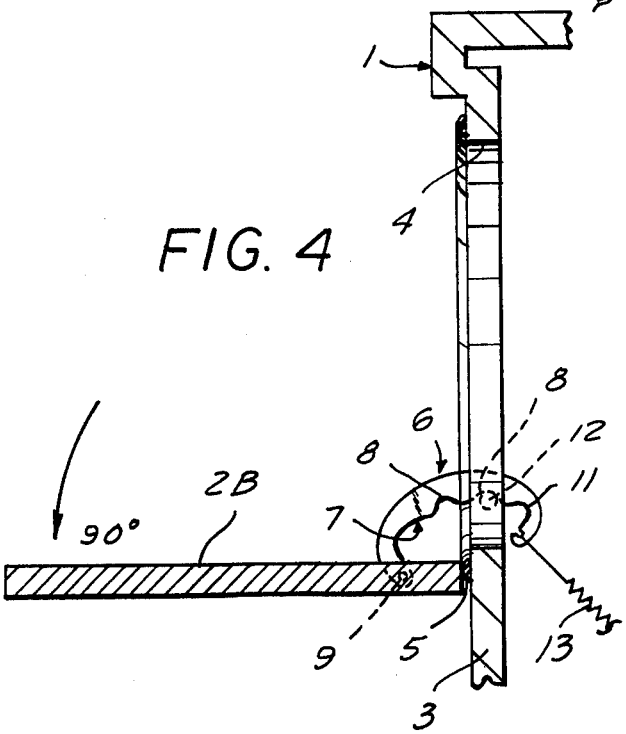

With reference to FIG. 1, an appliance 1 such as a clothes dryer, has a closed access door 2 which may be opened and held at several predetermined positions as shown by 2A, 2B, and 2C. In the position shown by door 2C, it is adjacent to the face of the lower portion 3 of the appliance 1 but does not come in contact with the lower portion 3. In this fully opened position 2C, unobstructed access is had to the interior of the appliance through the opening or portal 4 of the appliance 1. (see FIG. 5).

FIGS. 2 through 5 show the door in various positions illustrated in FIG. 1 as 2, 2A, 2B, and 2C, taken along the line A—A of FIG. 1, respectively. The position 2 corresponds to the fully closed position of the door. The position 2A is approximately a 45° position in which the door acts as a clothes chute. The position 2B is substantially a 90° position that permits the door to be used for piling of clothes. The position 2C corresponds to substantially a 180° open position that permits unobstructed access to the interior of the dryer. The door 2 is pivotably secured to the appliance through a hinge 5 which may be any usually employed device.

The door stop assembly construction 6, includes a link 15 having an inner arcuate surface 7 preferably with detents 8 defined therein, and is pivotably secured to the door 2, near one end utilizing a pivot 9. An end detent 11 is defined by a hooked portion formed in the link 15 on the embodiment shown, this detent lies along a line substantially passing through the pivot 9. A roller, pin, or similar support 12 is supported transversely to the arcuate surface 7, on the appliance 1 and interengages, as shown in FIGS. 2 through 6, with the grooves or notches 8 and the detent 11, to hold the door 2 in one of several predetermined positions. A biasing means such as the spring 13 is preferably provided to bias the arcuate surface 7 against the roller 12 and to counterbalance the door. Thus, one end of the spring 13 is connected to the link 15 adjacent the free end 16 thereof and the other end is connected at 17 to the bottom wall of the appliance housing.

Figure 5:
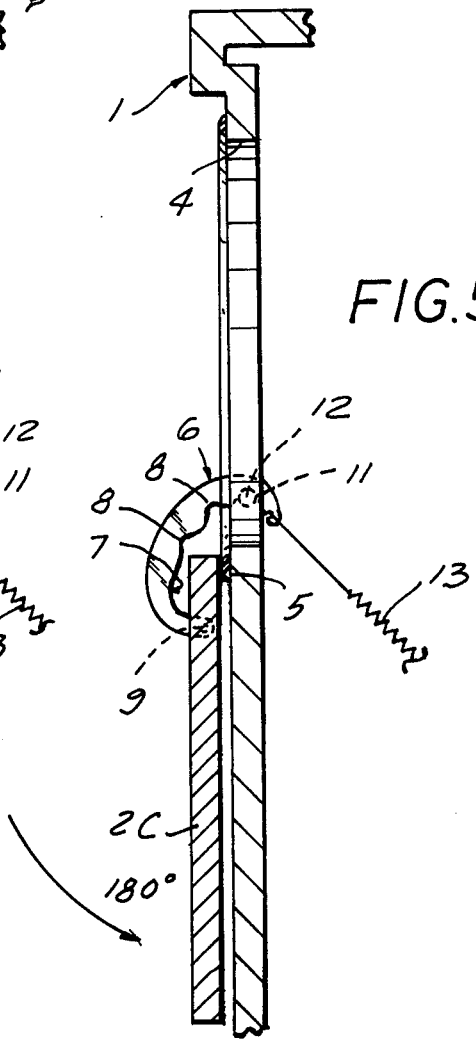

The end detent 11 is sized and positioned to receive the roller 12 therein when the door is in substantially a 180° open position, as shown in FIG. 5. On the other hand, the intermediate detents 8 are positioned so that the detents will receive the roller 12 when the door is at approximately 45° and 90° positions, respectively.

In operation, as the door 2 is pulled open, the arcuate surface 7 is moved over the roller 12 and is biased against the roller 12 by spring 13, which also counterbalances the door. As each detent 8 or detent 11, interengages with the roller 12, sufficient stability will be acquired by the system to prevent the weight of the door 2 alone from causing the roller 12 from moving out of interengagement with the detents. The detent 11 acts to limit the maximum extent to which the door 2 can be opened.

When in the fully open position, as shown in FIG. 5, the door 2C is stopped and held adjacent to, but spaced apart from the face portion of the appliance 3, as a result of the placement of the roller 12 and the spacing between the detent 11 and the pivot means 9, along arcuate surface 7. As is obvious from FIG. 5, the door 2C can be stopped and held any desired distance apart from the lower portion of the appliance 3 by either moving the roller 12 back further; changing the displacement between the detent 11 and the pivot pin 9; or a combination of these. Because of the nature of the appliance, and the especially relatively small thickness of the wall 14 normally found on the appliance 1, there is not, practically, a large variation available in the placement of the roller 12 portion of the door stop 6. Thus, if adjustment is necessary, it is preferably made by adjusting the spacing to that which is required.

Additionally, as other variations or modifications would be obvious to a person of ordinary skill in the art, it is not intended that the scope of the invention be limited to the exact details of construction set forth above.

What is claimed is:

1. A door stop assembly in combination with an appliance having an access door pivotably secured near its lower edge to the front of the appliance; said door stop assembly comprising:

a unitary arcuate link pivotably secured at a point adjacent one end to the door;

said link having an inner arcuate surface;

roller means secured to the appliance and disposed transverse to the curvature of said inner arcuate surface;

a first detent in said inner surface of said link sized and positioned to engage said roller means when said door is in a substantially 180° open position to limit and maintain said door in said 180° open position, said detent comprising a hooked portion;

and biasing means connected to said link adjacent the other end thereof to bias said inner arcuate surface of said link into engagement with said roller means throughout the length of travel of said link, said biasing means comprising a spring connected between said other end of said link and the bottom wall of said appliance.

2. The combination of claim 1, in which said link is provided with a plurality of circumferentially spaced detents along said arcuate surface, each of said detents being sized and positioned to engage said roller means to maintain said door in correspondingly different angular positions.

3. The combination of claim 2, in which said detents are spaced to orient said door in substantially 45° and 90° angular positions, as viewed from the side of said appliance.

4. A door stop assembly for use with an appliance having an enclosed housing provided with a front wall having an access door pivotably secured near its lower edge to the front of the appliance, comprising:

a unitary arcuate link adapted to be pivotably secured to a point adjacent one end to the door, said link having an inner arcuate surface;

roller means adapted to be secured to the housing to provide a support on which said arcuate surface is operable to ride;

a first detent on said inner arcuate surface sized and positioned to receive said roller means therein when said door is in a substantially 180° open position to limit movement of the door to, and maintain the door in said substantially 180° open position;

and a spring connected between the other end of said link and the housing for biasing said link into continuous engagement with said roller means throughout the length of travel of said link;

said first detent comprising a hooked end.

5. A door stop assembly as in claim 4, and a plurality of detents circumferentially spaced along said arcuate surface, between said one end and said first detent, each of said plurality of detents being operable to engage said roller means to maintain the door in correspondingly different orientations.

* * * * *